US006729933B2

(12) United States Patent
Hoeting et al.

(10) Patent No.: US 6,729,933 B2
(45) Date of Patent: May 4, 2004

(54) ARTICULATED RIDER FOR A TOY VEHICLE

(75) Inventors: Michael G. Hoeting, Cincinnati, OH (US); Robert P. Spalinski, Titusville, NJ (US)

(73) Assignee: Bang Zoom Design, Ltd., Cincinnati, OH (US)

( * ) Notice: Subject to any disclaimer, the term of this patent is extended or adjusted under 35 U.S.C. 154(b) by 0 days.

(21) Appl. No.: 10/268,508

(22) Filed: Oct. 10, 2002

(65) Prior Publication Data

US 2003/0082989 A1 May 1, 2003

Related U.S. Application Data

(60) Provisional application No. 60/339,885, filed on Oct. 31, 2001, and provisional application No. 60/371,908, filed on Apr. 11, 2002.

(51) Int. Cl.[7] ..... A63H 17/25

(52) U.S. Cl. ..... 446/275; 446/288; 446/440

(58) Field of Search ..... 446/269, 275, 446/279, 280, 288, 437, 440, 454, 317

(56) References Cited

U.S. PATENT DOCUMENTS

| | | | | |
|---|---|---|---|---|
| 1,692,714 | A | | 11/1928 | Wetzell |
| 2,175,845 | A | | 10/1939 | Lohr |
| 2,250,215 | A | | 7/1941 | Berger |
| 2,645,056 | A | * | 7/1953 | Mangold |
| 2,814,908 | A | | 12/1957 | Ernst |
| 3,546,814 | A | | 12/1970 | Melendez |
| 3,650,067 | A | | 3/1972 | Greenwood |
| 3,886,682 | A | | 6/1975 | Ieda et al. |
| 4,267,663 | A | | 5/1981 | Nagahara |
| 4,290,228 | A | | 9/1981 | Goldfarb et al. |
| 4,342,175 | A | | 8/1982 | Cernansky et al. |
| 4,355,482 | A | * | 10/1982 | Sapkus et al. |
| 4,363,186 | A | | 12/1982 | Goldfarb et al. |
| 4,526,554 | A | | 7/1985 | Goldfarb et al. |
| 4,563,164 | A | | 1/1986 | Tao |
| 4,966,569 | A | | 10/1990 | Asano |
| 5,368,516 | A | | 11/1994 | Hoeting et al. |
| 6,074,271 | A | | 6/2000 | Derrah |
| 6,095,891 | A | | 8/2000 | Hoeting et al. |
| 6,095,892 | A | | 8/2000 | Moe |

FOREIGN PATENT DOCUMENTS

| | | | |
|---|---|---|---|
| GB | 2130495 | * | 6/1984 |
| JP | 56-13971 | | 2/1981 |

OTHER PUBLICATIONS

Tyco R/C TMH X–Treme Cycle™ Owner's Manual, Mattel, Inc., Mt. Laurel, NJ, four pages, 1999.

Tyco R/C TMH X–Treme Cycle Official X–Treme Cycle™ Driving Guide!, Mattel, Inc., Mt. Laurel, NJ, two pages, 1999.

Three photographs of the Tyco R/C TMH X–Treme Cycle™ accompanying the above two documents (1999).

* cited by examiner

*Primary Examiner*—Jacob K. Ackun
*Assistant Examiner*—Jamila Williams
(74) *Attorney, Agent, or Firm*—Akin Gump Strauss Hauer & Feld, LLP

(57) ABSTRACT

An articulated toy figure includes a torso and pairs of articulated arms and legs. The articulated legs are engaged with the torso at a pair of hip joints, each rotatable about two substantially perpendicular horizontal axes. Each leg has an upper member and a lower member engaged with the upper member at a knee joint to rotate about a third horizontal axis. The hip and knee joints are sufficiently lax for each leg to rotate when moved from an initial position to a displaced, raised position and to return towards the initial position when the leg is released to substantially simulate possible leg movements of a human being. A spring connected between each of the upper leg members and the torso biases each upper leg to return to its initial position after having been moved.

25 Claims, 5 Drawing Sheets

ARTICULATED RIDER FOR A TOY VEHICLE

CROSS-REFERENCE TO RELATED APPLICATIONS

This patent application claims priority to U.S. Patent Application No. 60/339,885, filed Oct. 31, 2001, and U.S. Patent Application No. 60/371,908, filed Apr. 11, 2002, both entitled "Articulated Rider for a Two-Wheeled Toy Vehicle".

BACKGROUND OF THE INVENTION

This invention generally relates to an articulated figure used in combination with a remote-controlled toy vehicle, and more particularly to an articulated rider figure for use with a remote-controlled toy motorcycle.

Remote-controlled vehicles are generally known. Specifically, two-wheeled remote-controlled toys are generally known. U.S. Pat. No. 6,095,891 discloses a two-wheeled wireless controlled toy motorcycle with improved stability in which a four-bar steering mechanism and a weighted gyroscopic flywheel are used to enhance the stability of the vehicle.

Articulated toy figures are also generally known. However, their use together is not generally known. It would be advantageous to use an articulated rider figure in conjunction with a ridden toy vehicle like a motorcycle, particularly, to simulate the performance of freestyle tricks by the rider when the vehicle is driven over jumps and bumps.

BRIEF SUMMARY OF THE INVENTION

Briefly stated, in one aspect, the present invention is an articulated toy figure including a torso, a pair of articulated legs, and at least one hip spring. The torso has a front side, a rear side, and two opposing lateral sides between the front and rear sides. The pair of articulated legs are rotatably engaged with the torso at a pair of hip joints. Each hip joint is rotatable about two horizontal axes. A first horizontal axis extends generally through the front and rear sides. A second horizontal axis extends generally through the lateral sides of the torso. Each leg has a lower leg member and an upper leg member. The lower leg member is rotatably engaged with the upper leg member at a knee joint. The knee joint is rotatable about a third horizontal axis extending generally parallel to the second horizontal axis. The knee joint has a stop to prevent forward hyperextension of the lower leg with respect to the upper leg at the knee joint. The hip and knee joints are sufficiently lax for each leg to rotate when raised from an initial position to a higher displaced position and to return toward the initial position when the leg is released, whereby the articulated figure substantially simulates possible leg movements of a human being. The at least one hip spring is connected between at least one of the upper leg members and the torso, so as to bias the at least one upper leg to return to the initial position after having been moved from the initial position.

In another aspect, the present invention is a combination toy including a toy vehicle, an articulated toy figure, and at least one torsional spring. The toy vehicle has a propulsion motor for self movement and a handlebar with distal ends. The articulated toy figure has a torso with a plurality of limbs including at least a pair of arms with ends engaged with the distal ends of the handlebar while the figure is in a seated position on the vehicle. The at least one torsional spring is operably coupled with at least one of the handlebar and the arms so as to bias the toy figure back to the seated position on the vehicle when the figure is bounced up from the seated position during movement of the vehicle.

In another aspect, the present invention is an articulated rider for use with a remotely controlled toy vehicle. The rider comprises a torso and at least one torsional spring. The torso has rotatable limbs. The at least one torsional spring is removably coupled with at least one limb of the rider to rotatably couple the rider to the vehicle. The rotatable limbs randomly rotate from an initial riding position in response to the movements of the vehicle. The at least one limb is biased to return to the initial riding position by the at least one torsional spring, thereby simulating movements of a rider performing freestyle stunts.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
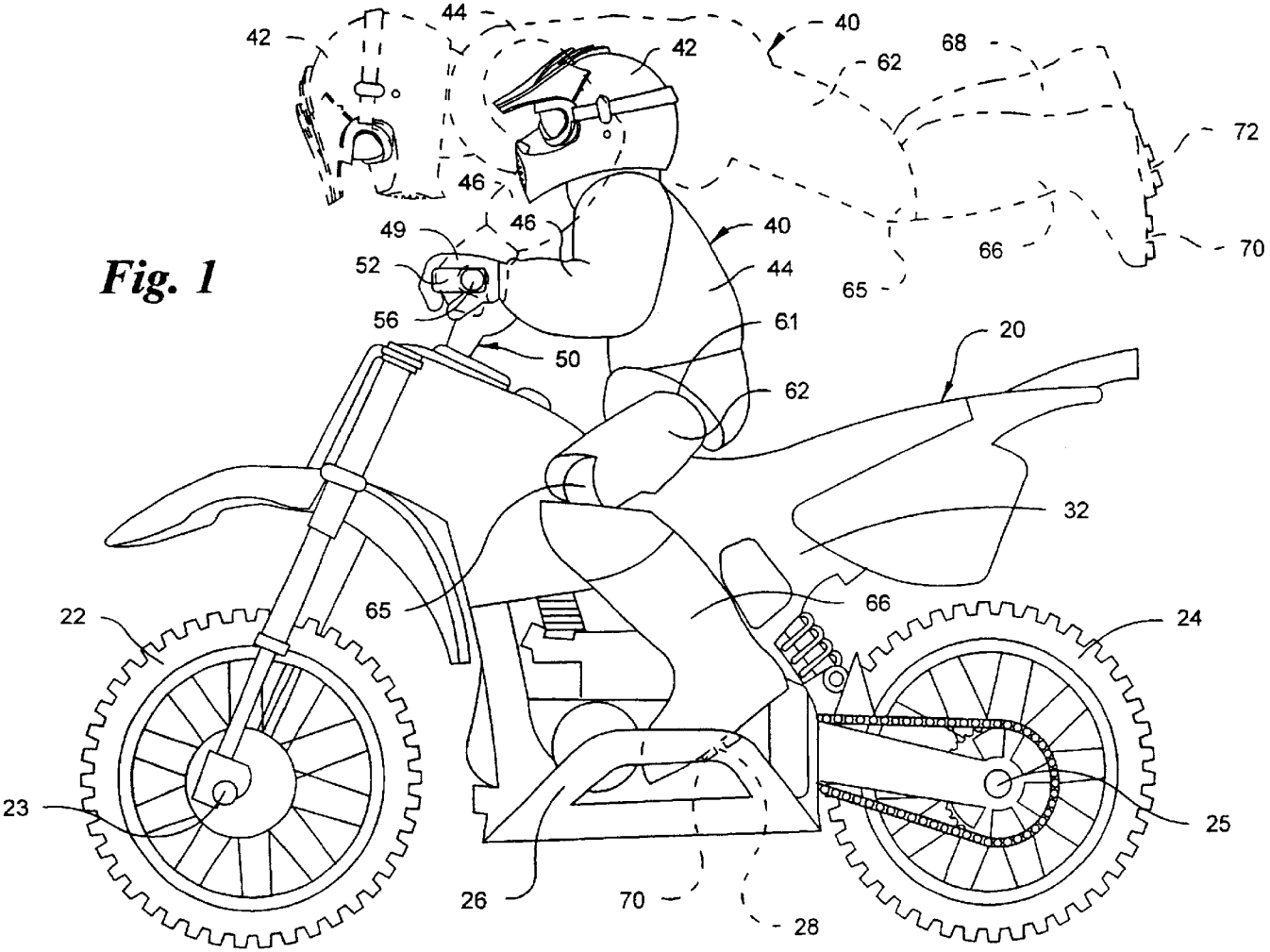
FIG. 1 is an left elevational view of a toy in accordance with a preferred embodiment of the present invention with an articulated rider figure in a sitting position and a raised position parallel to a motorcycle portion (in phantom)

Certain terminology is used in the following description for convenience only and is not limiting. The words "right", "left", "upper" and "lower" designate directions in the drawings to which reference is made. The terminology includes the words above specifically mentioned, derivatives thereof, and words of similar import.

Figure 2:
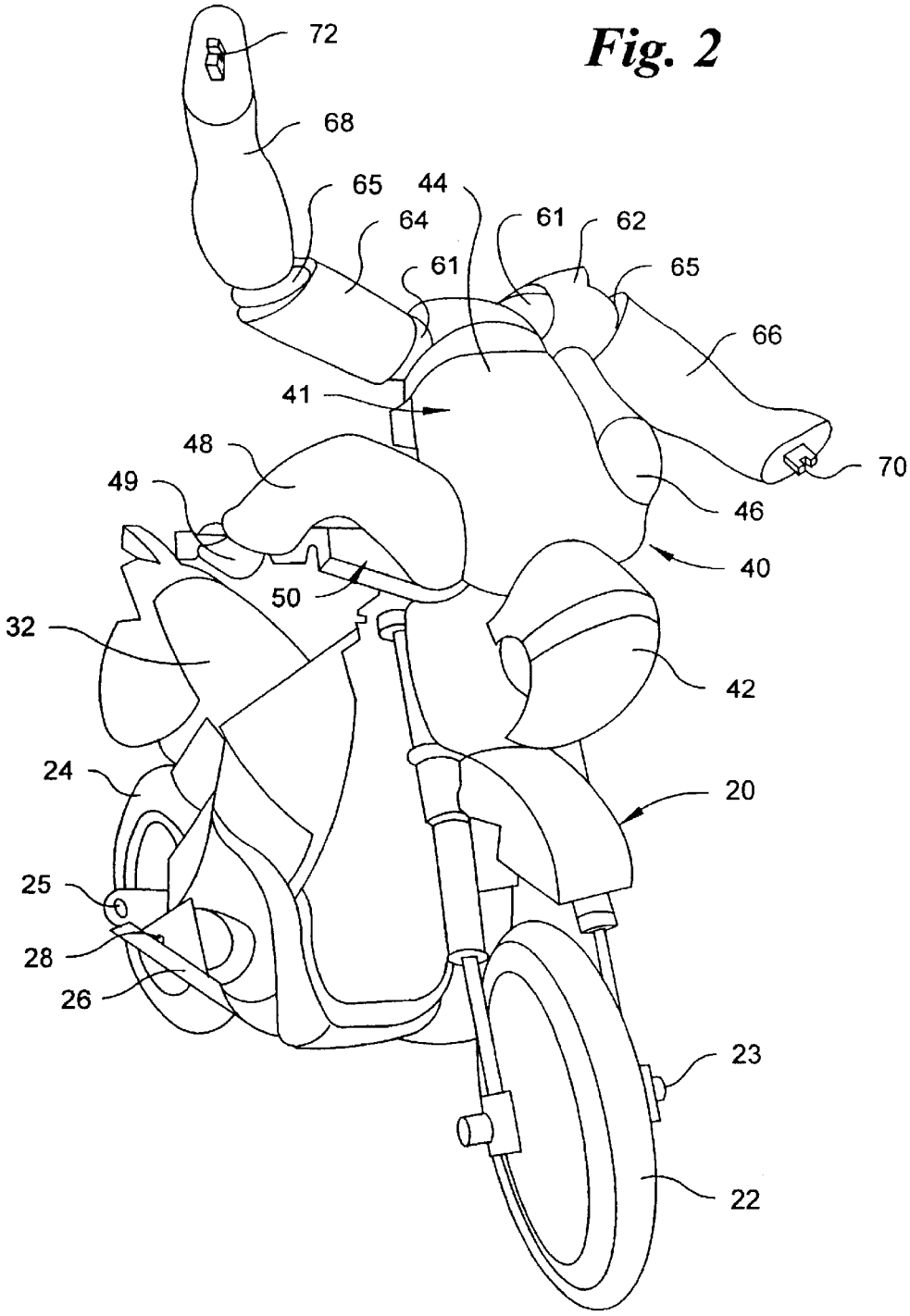
FIG. 2 is a perspective view of the right, front side of the toy in FIG. 1 with the articulated rider figure in a raised position from the motorcycle portion.

Referring to the drawings in detail, wherein like numerals indicate like elements throughout, there is shown in FIGS. 1 through 5 a preferred embodiment of a toy vehicle 10 in accordance with the present invention. A remotely controlled vehicle, indicated generally at 10, embodying the preferred embodiment of the invention is shown in FIGS. 1 and 2. The vehicle 10 comprises a motorcycle portion 20 and a rider portion 40. The motorcycle portion 20 comprises a main body 32, a front wheel 22 freely rotatable about a front axle 23, a back wheel 24 rotatable about a back axle 25 and operatively connected to and powered by a drive motor (not depicted), and a skid plate 26 with right and left skid plate attachment points 28, 30. The skid plate 26 aids in keeping the vehicle 10 upright and traveling on its front and back wheels 22, 24 by allowing the vehicle 10 to lean over partially but not so far as to cause the front and back wheels 22, 24 to leave the ground.

Although the main body 32 of the present invention consists of a pair of mated half-shells, it is within the spirit and scope of the present invention that the main body 32 be some other monocoque construction or a separate frame/separate body construction. "Main body" is intended to cover both a monocoque construction in which the body also functions as a chassis bearing loads on the vehicle as well as a conventional chassis supporting a separate mounted body.

Figure 3:
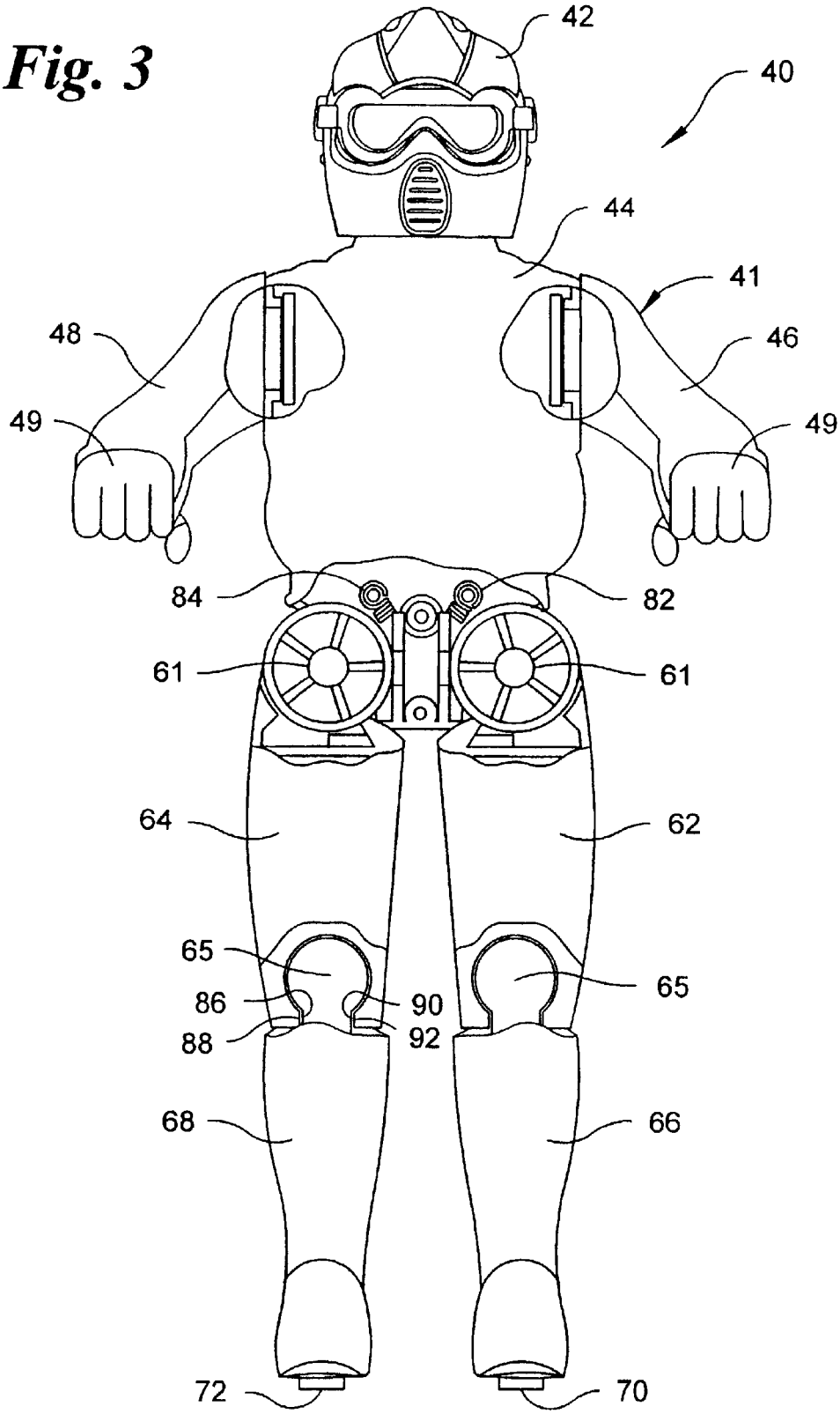
FIG. 3 is a front elevational view of the figure of the toy in FIG. 1.
Figure 4:
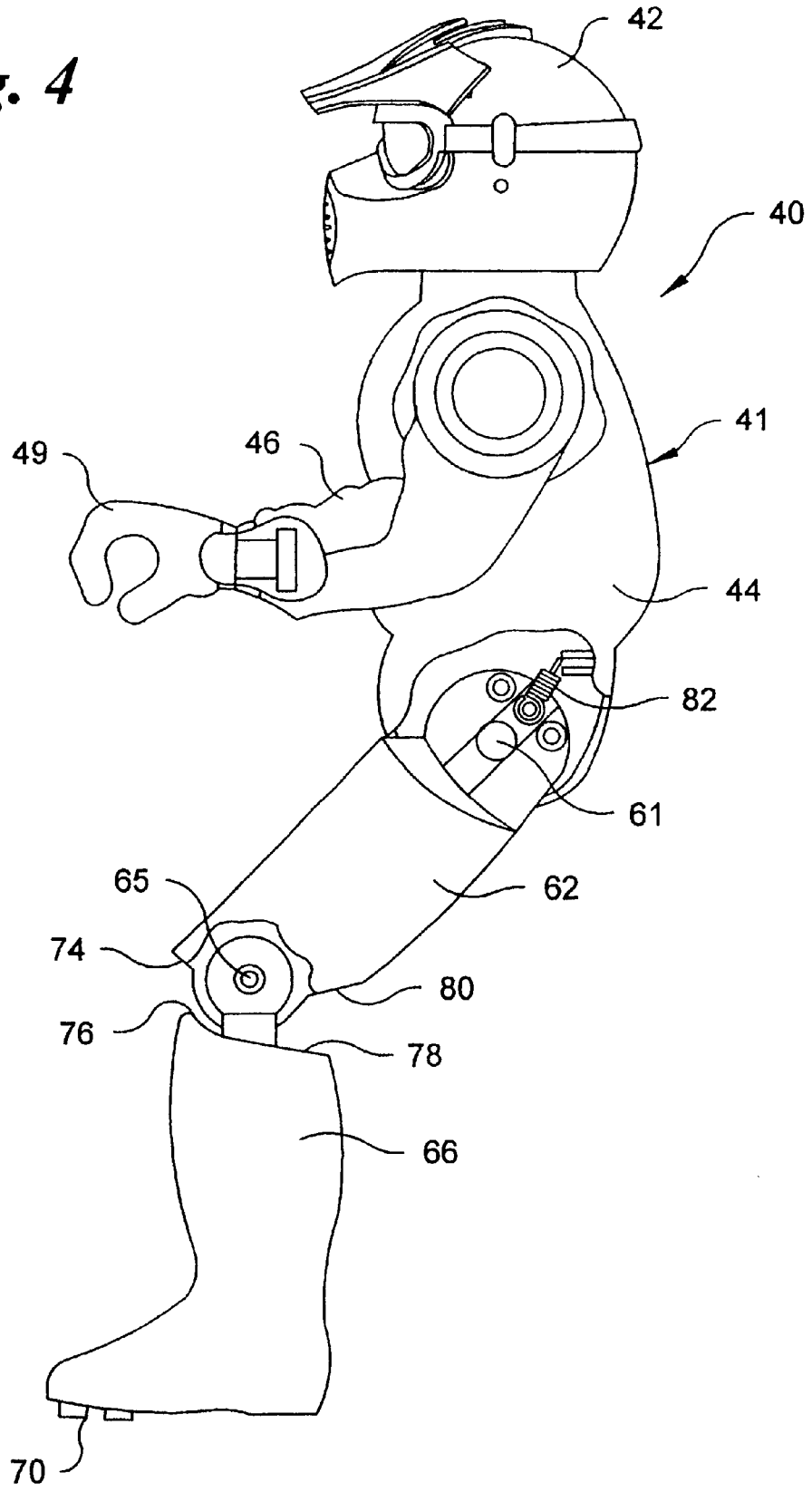
FIG. 4 is a left elevational view of the figure of the toy in FIG. 1.
Figure 5:
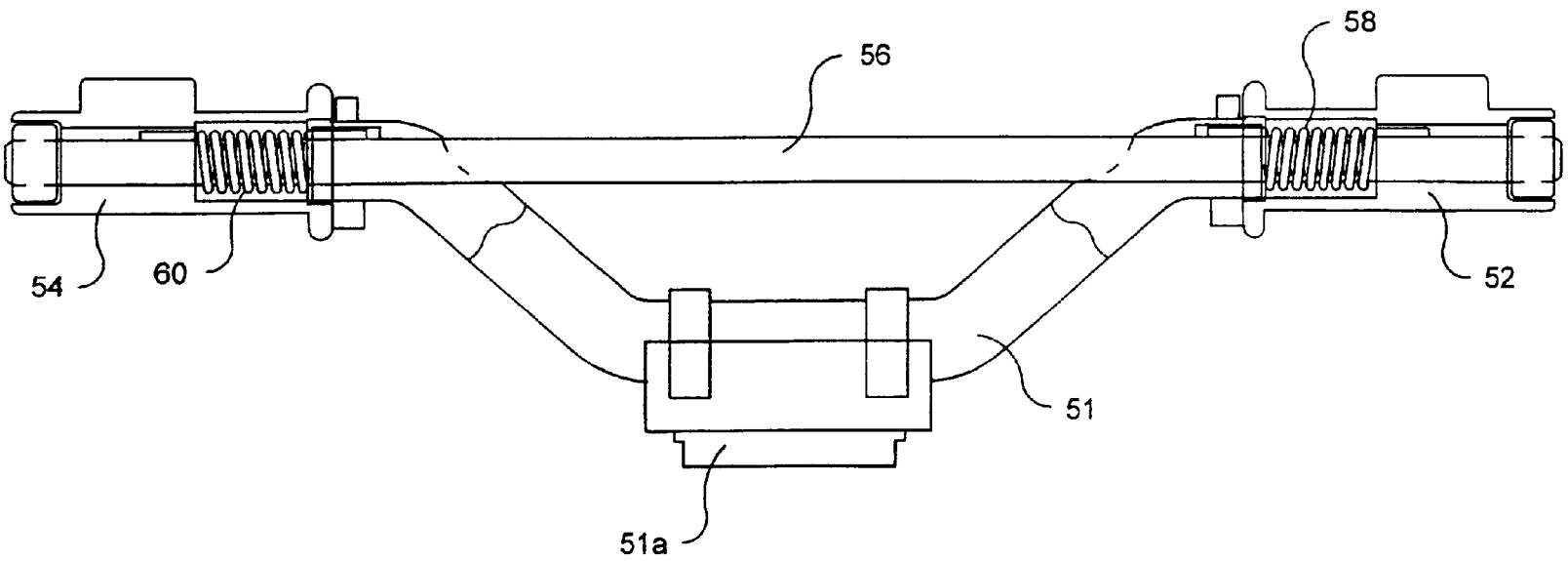
FIG. 5 is a front elevational view of the handlebar assembly of the toy in FIG. 1.

Referring to FIG. 3, the rider portion 40 is an articulated figure 41 with a handlebar assembly 50 (FIG. 5). The figure 41 comprises a head member 42; a torso member 44; left and right arm members 46, 48; left and right upper leg members 62, 64; left and right lower leg members 66, 68; and left and right boot attachment points 70, 72. The head member 42 is in engagement with the top of the torso member 44. The torso member 44 has a front side, a rear side, and two opposing lateral sides between the front and rear sides. The left and right arm members 46, 48 are rotatably engaged with the handlebar assembly 50 at their distal ends and rotatably engaged with the torso member 44 at their proximal ends, allowing the figure 41 to lift from-the motorcycle portion 20 and consistently return to a seated position after the vehicle 10 has landed from a jump. The left and right upper leg members 62, 64 are connected to the torso portion 44 with a pair of hinges, effectively acting as hip joints 61, allowing free rotation of the left and right upper leg members 62, 64 with respect to the torso member 44 about two horizontal axes. A first horizontal axis extends generally through the front and rear sides and the second horizontal axis extends generally through the lateral sides of the torso member 44. Left and right hip springs 82, 84 are connected between the torso member 44 and the left and right upper leg members 62, 64, respectively. The left and right lower leg members 66, 68 are attached to the left and right upper leg members 62, 64 with ball joints, providing free rotation of the left and right lower leg members 66, 68 with respect to the left and right upper leg members 62, 64. The ball joints effectively act as knee joints 65. The presence of the knee joints 65 allows for free rotation of the leg members 62, 64, 66, 68, limited only by the interaction of adjacent stop surfaces 74, 76, 78, 80 (FIG. 4) and adjacent guide surfaces 86, 88, 90, 92 (FIG. 3) to preclude unnatural movement. The knee joints 65 are generally rotatable about a third horizontal axis. The third horizontal axis extends generally parallel to the second horizontal axis.

The hip joints 61 between the torso 44 and the upper leg members 62, 64 and the knee joints 65 between the upper leg members 62, 64 and the lower leg members 66, 68 are sufficiently lax to permit rotation, when moved by an external force, from an initial position to a displaced position and to return to the initial position upon cessation of the external force, thereby simulating possible leg movements of a human being. The hip springs 82, 84 act to bias the upper leg members 62, 64 toward the initial position after having been moved from the initial position. Although the figure 41 is described as having two hip springs 82, 84, it is within the spirit and scope of the present invention for only one upper leg member 62 to have one hip spring 82.

At the bottom of the left and right lower leg members 66, 68 are the left and right boot attachment points 70, 72, which allow for optional engagement with the left and right skid plate attachment points 28, 30. The boot attachment points 70, 72 can be removably engaged (slidably or snap, depending upon the design) with the skid plate attachment points 28, 30, at the option of the user, to maintain the feet of the rider portion 40 locked to the skid plate 26 and prohibit the rider portion 40 from freely moving, thereby enabling the vehicle 10 to act as a normal remotely controlled toy motorcycle in a first mode of play. The attachment does not prevent all movement of the rider portion 40 on the motorcycle portion 20. Disengaging the boot attachment points 70, 72 from the skid plate attachment points 28, 30 allows the rider portion 40 to move freely in response to jumps and bumps which the vehicle 10 is controlled over by the user, thereby simulating free style stunts in a second mode of play.

Referring to FIG. 5, the handlebar assembly 50 comprises a cross member or handlebar 51; left and right grips 52, 54; a shaft 56; and left and right springs 58, 60. The cross member 51 is generally U-shaped, larger in width than in height, with the distal ends of the cross member 51 turned outwardly to define opposing lateral sides of the cross member 51. The handlebar assembly 50 is configured to generally mimic a conventional motorcycle handlebar in appearance. The base 51*a* of the cross member 51 is rigidly engaged with the motorcycle portion 20. The outwardly turned distal ends of the cross member 51 are hollow to accommodate the shaft 56 extending therethrough, generally parallel to the base of the cross member 51 and extending outwardly from the ends of the cross member 51. The left and right grips 52, 54 are engaged with the ends of the shaft 56 such that they conceal the ends of the shaft 56 protruding from the ends of the cross member 51. The grips 52, 54 and the shaft 56 are rotatable within the ends of the cross member 51. The grips 52, 54 are removably engaged by hands 49 at the distal ends of the arm members 46, 48 of the rider portion 40. The grips 52, 54 provide the rotatable connection of the hands 49 with the handlebar 50. The left and right springs 58, 60 are held within the grips 52, 54 in engagement with the shaft 56 and anchored against the ends of the cross member 51. The springs 58, 60 are torsional and facilitate the rider portion 40 to lift up from the motorcycle portion 20 and rotate partially about the cross member 51 in response to jumps and bumps (FIGS. 1 and 2). More particularly, the torsional springs 58, 60 are under maximum torsional load when the figure 41 is seated on the motorcycle portion 20 and unload or relax as the figure 41 elevates off the motorcycle portion 20. Once the vehicle 10 completes its maneuvers, gravity overcomes the force of the torsional springs 58, 60, and the rider portion 40 falls back into a seated position on the motorcycle portion 20, reloading the torsional springs 58, 60. The springs 58, 60 are not strong enough to maintain the rider portion 40 in a rotated position. Either hand 49 can be removed from the handlebar assembly 50 to simulate one-handed stunts as the vehicle 10 is driven over bumps and jumps.

In another embodiment (not separately shown), the handlebar assembly 50 has one torsional spring 58 and one rotatable grip 52 that is engaged by the torsional spring 58 and one hand 49. The one hand 49 cannot be removed from the handlebar assembly 50. The remaining hand 49 is in optional engagement with the handlebar assembly 50 and can be removed from the handlebar assembly 50 to simulate one-handed stunts as the vehicle 10 is driven over bumps and jumps.

In another embodiment, the handlebar assembly 50 has no shaft 56. Instead, the grips 52, 54 are independently rotatably engaged with the handlebar assembly 50. At least one of the grips 52, 54 has at least one of the torsional springs 58, 60 engaged between the at least one grip 52, 54 and the handlebar assembly 50 so that the at least one of the grips 52, 54 is spring-biased to return the figure 41 toward the original position after having been moved.

In another embodiment, fixed grips 52, 54 are engaged with the handlebar assembly 50, and the figure 41 is rotatable about the grips 52, 54 at hands 86, 88. The torsional springs 58, 60 are engaged between the hands 86, 88 and the fixed grips 52, 54 so as to bias the FIG. 41 toward the original position.

In another embodiment, there are no grips 52, 54. The figure 41 is rotatably engaged directly with the handlebar assembly 50, the hands 49 being rotatable about the handlebar assembly 50. The torsional springs 58, 60 are engaged between the hands 49 of the figure 41 and the handlebar assembly 50, so as to bias the figure 41 toward the original position.

In another embodiment, the arms 46, 48 of the figure 41 are rotatably engaged with the handlebar assembly 50, the figure 41 not having separate distinct hands 49.

The vehicle 10 is used with a hand operated remote control unit (not depicted) having a pair of manual controls and control and radio transmission circuitry, which is conventional. One manual control activates a drive motor (not depicted), which causes rotation of the back wheel 24 (FIG. 1) about the back axle 25 (FIG. 1). The other manual control activates a steering motor (not depicted), which causes rotation of the front wheel 22 (FIG. 1).

Additional features of the vehicle 10 including the propulsion and steering drives and others not expressly referenced are described in U.S. Pat. No. 6,095,891, which is incorporated by reference herein. Also incorporated by reference herein are U.S. Patent Application Nos. 60/339,885 and 60/371,908, which are related to this application. While the invention has been described with respect to a motorcycle, it will be appreciated that it could be incorporated into other types of vehicles equipped with handlebars to be ridden by a rider including motorbikes, three and four wheel all terrain vehicles (ATV's), snow mobiles, and wave runners.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An articulated toy figure comprising:

a torso with a front side, a rear side, and two opposing lateral sides between the front and rear sides;

a pair of articulated legs rotatably engaged with the torso at a pair of hip joints, each hip joint being rotatable about two horizontal axes, a first horizontal axis extending generally through the front and rear sides and a second horizontal axis extending generally through the lateral sides of the torso, each leg having a lower leg member and an upper leg member, the lower leg member being rotatably engaged with the upper leg member at a knee joint, the knee joint being rotatable about a third horizontal axis extending generally parallel to the second horizontal axis, the knee joint having a stop to prevent forward hyperextension of the lower leg with respect to the upper leg at the knee joint, the hip and knee joints being sufficiently lax for each leg to rotate when raised from an initial position to a higher displaced position and to return toward the initial position when the leg is released, whereby the articulated figure substantially simulates possible leg movements of a human being; and at least one hip spring connected between at least one of the upper leg members and the torso, so as to bias the at least one upper leg to return to the initial position after having been moved from the initial position.

2. The articulated toy figure of claim 1 further comprising another hip spring connected between a remaining one of the upper leg members and the torso, so as to bias the remaining one upper leg to return to the initial position after having been moved from the initial position.

3. The articulated toy figure of claim 1 wherein the at least one hip spring biases at least the one upper leg member about at least the second horizontal axis.

4. The articulated toy figure of claim 3 wherein the at least one hip spring biases at least the one upper leg member about at least the first horizontal axis.

5. The articulated toy figure of claim 1 wherein the at least one hip spring biases at least the one upper leg member about at least the first horizontal axis.

6. The articulated rider of claim 5 in combination with a toy vehicle having a handlebar assembly with a rotatable grip member on each side of the handlebar assembly.

7. The combination toy of claim 6 wherein the rider further includes a hand at a distal end of each of the two arms, the hands being engaged with the grip members, at least one of the hands and the grip members being operably coupled with a torsional spring to bias the at least one grip member and engaged hand to a nominal position, the at least one grip member being rotatable in a first direction from the nominal position to apply a torsion load to the torsional spring.

8. The combination toy of claim 7 wherein the arms of the toy figure are rotatably attached to the torso and wherein the hands are rotatably attached to the arms.

9. The combination toy of claim 6 wherein the lower leg members have distal ends removably engageable with the vehicle.

10. The combination toy of claim 6 wherein the vehicle is a two-wheeled remotely-controlled motorcycle.

11. A combination toy comprising:

a toy vehicle having a propulsion motor for self movement and a handlebar with distal ends;

an articulated toy figure having a torso with a plurality of limbs including at least a pair of arms with ends engaged with the distal ends of the handlebar while the figure is in a seated position on the vehicle; and at least one torsional spring operably coupled with at least one of the handlebar and the arms so as to bias the toy figure back to the seated position on the vehicle when the figure is bounced up from the seated position during movement of the vehicle.

12. The combination toy of claim 11, wherein the torso includes a front side, a rear side, and two opposing lateral sides between the front and rear sides, and wherein the articulated figure further includes a pair of articulated legs rotatably engaged with the torso at a pair of hip joints, each hip joint being rotatable about two horizontal axes, a first horizontal axis extending generally through the front and rear sides and a second horizontal axis extending generally through the lateral sides of the torso, each leg having a lower leg member and an upper leg member, the lower leg member being rotatably engaged with the upper leg member at a knee joint, the knee joint being rotatable about a third horizontal axis extending generally parallel to the second horizontal axis, the knee joint having a stop to prevent forward hyperextension of the lower leg with respect to the upper leg at the knee joint, the hip and knee joints being sufficiently lax for each leg to rotate when raised from an initial position to a higher displaced position and to return toward the initial position when the leg is released, whereby the articulated figure substantially simulates possible leg movements of a human being; and at least one hip spring connected between at least one of the upper leg members and the torso, so as to bias the at least one upper leg to return to the initial position after having been moved from the initial position.

13. The combination toy of claim 11 wherein the handlebar is an assembly including a handlebar member having the opposing distal ends;

a shaft rotatably engaged with the handlebar member, the shaft being oriented along and rotatable about a horizontal axis extending generally through the distal ends of the handlebar member;

a grip engaged with each end of the shaft and rotatable therewith; and the at least one torsional spring being coupled between at least the one rotatably engaged grip and the handlebar member, so as to bias the shaft and the grips toward an original position after rotation of the shaft.

14. The combination toy of claim 13 wherein the shaft and the handlebar have stop members to limit rotation of the shaft with respect to the handlebar assembly.

15. The combination toy of claim 12, the articulated toy figure further comprising at least another hip spring connected between a remaining one of the upper leg members and the torso, so as to bias the remaining one upper leg member to return to the initial position after having been moved from the initial position.

16. The combination toy of claim 12 wherein the at least one hip spring biases at least the one upper leg member about at least the second horizontal axis.

17. The combination toy of claim 16 wherein the at least one hip spring biases at least the one upper leg member about at least the first horizontal axis.

18. The combination toy of claim 12 wherein the at least one hip spring biases at least the one upper leg member about at least the first horizontal axis.

19. The combination toy of claim 12 wherein the lower leg members have distal ends removably engageable with the vehicle.

20. The combination toy of claim 11 wherein the vehicle is a two-wheeled remotely-controlled motorcycle.

21. The combination toy of claim 11 wherein the arms are rotatably engaged with the torso.

22. The combination toy of claim 11 wherein the arms are arm members with rotatably mounted hand members configured to grip the distal ends of the handlebars.

23. The combination toy of claim 22 wherein at least one of the hand members is configured to releasably grip one of the distal ends of the handlebar.

24. An articulated rider for use with a remotely controlled toy vehicle, the rider comprising:

a torso with rotatable limbs; and at least one torsional spring removably coupled with at least one limb of the rider to rotatably couple the rider to the vehicle;

wherein the rotatable limbs randomly rotate from an initial riding position in response to the movements of the vehicle, at least one limb being biased to return to the initial riding position by the at least one torsional spring, thereby simulating movements of a rider performing freestyle stunts.

25. The articulated rider of claim 24 in combination with a remotely controlled toy vehicle configured to receive the rider in a seated position straddling the toy vehicle.

* * * * *